US007841386B2

(12) United States Patent
Wang et al.

(10) Patent No.: US 7,841,386 B2
(45) Date of Patent: Nov. 30, 2010

(54) ANTI-BREAKING STRUCTURE FOR END CLOSURE OF HEAT PIPE

(75) Inventors: Tony Wang, Taipei (TW); Meng-Cheng Huang, Taipei (TW)

(73) Assignee: Chaun-Choung Technology Corp., Taipei (TW)

( * ) Notice: Subject to any disclaimer, the term of this patent is extended or adjusted under 35 U.S.C. 154(b) by 930 days.

(21) Appl. No.: 11/685,830

(22) Filed: Mar. 14, 2007

(65) Prior Publication Data

US 2008/0222890 A1 Sep. 18, 2008

(51) Int. Cl.
*B23P 6/00* (2006.01)
*F28D 15/00* (2006.01)

(52) U.S. Cl. ..... 165/104.21; 29/890.032

(58) Field of Classification Search ..... 165/104.21, 165/104.26, 104.32, 104.33; 361/700; 29/890.032
See application file for complete search history.

(56) References Cited

U.S. PATENT DOCUMENTS 4,633,371 A * 12/1986 Nagy et al. ..... 165/104.33
5,379,830 A * 1/1995 Itoh ..... 165/104.33
5,412,535 A * 5/1995 Chao et al. ..... 361/700
5,582,243 A * 12/1996 Velon ..... 165/916
5,632,158 A * 5/1997 Tajima ..... 165/104.26
5,743,014 A * 4/1998 Giammaruti et al. ... 29/890.032
6,725,909 B1 * 4/2004 Luo ..... 165/104.21
6,793,009 B1 * 9/2004 Sarraf ..... 165/104.33
6,827,133 B1 * 12/2004 Luo ..... 165/104.21
6,896,040 B2 * 5/2005 Hul-Chun ..... 165/104.26
6,938,680 B2 * 9/2005 Garner et al. ..... 165/104.26
6,973,964 B2 * 12/2005 Hul-Chun ..... 165/104.26
6,986,383 B2 * 1/2006 Hsu ..... 165/104.26
6,997,243 B2 * 2/2006 Hsu ..... 165/104.26
6,997,244 B2 * 2/2006 Hul-Chun ..... 165/104.26
7,013,957 B2 * 3/2006 Hsu ..... 165/104.26
7,040,382 B2 * 5/2006 Hsu ..... 165/104.26
7,152,667 B2 * 12/2006 Mochizuki et al. ..... 165/104.21
7,347,250 B2 * 3/2008 Li ..... 165/104.26
7,619,888 B2 * 11/2009 Yu et al. ..... 165/104.33
7,650,932 B2 * 1/2010 Li ..... 165/104.33
7,654,310 B2 * 2/2010 Li ..... 165/104.33
2004/0035555 A1 * 2/2004 Nara et al. ..... 165/104.22
2004/0105235 A1 * 6/2004 Lai ..... 361/700
2005/0011633 A1 * 1/2005 Garner et al. ..... 165/104.33
2005/0082043 A1 * 4/2005 Sarraf ..... 165/104.33
2007/0175613 A1 * 8/2007 Li ..... 165/104.21
2007/0175615 A1 * 8/2007 Li ..... 165/104.26
2007/0175616 A1 * 8/2007 Li ..... 165/104.33

* cited by examiner

*Primary Examiner*—Ljiljana (Lil) V Ciric
(74) *Attorney, Agent, or Firm*—Chun-Ming Shih; HDLS IPR Sevices

(57) ABSTRACT

An anti-breaking structure of an end closure of a heat pipe is formed at a tapered end of the heat pipe, and a soldering joint is formed at an upper end of the anti-breaking structure. The anti-breaking structure includes an uneven rib coupled longitudinally between the tapered end and the soldering joint, and two wing portions extended outward from the left and right outer sides of the uneven rib, and one surface of the uneven rib is convex and another backside surface of the uneven rib is concave, and both uneven rib and wing portions are formed by pressing the heat pipe to constitute the anti-breaking structure.

3 Claims, 6 Drawing Sheets

ANTI-BREAKING STRUCTURE FOR END CLOSURE OF HEAT PIPE

BACKGROUND OF THE INVENTION

1. Field of the Invention

The present invention relates to a heat pipe, and more particular to an anti-breaking structure for an end closure of a heat pipe.

2. Description of Prior Art

Heat pipe is a heat conducting component sealed in vacuum and filled with a working fluid. In FIG. 1, a conventional heat pipe 1*a* includes a pipe body 10*a*, a closed end 11*a* disposed at an end of the pipe body 10*a*, a tapered end 12*a* disposed on another end of the pipe body 10*a*, and an upper portion of the tapered end 12*a* is tapered into a tapered portion by a pipe tapering process and an end of the tapered portion is clamped by a pipe sealing tool to form a compressed pipe wall 13*a*, and a soldering joint 14*a* formed and soldered at the top of the compressed pipe wall 12*a* for sealing the tapered end 12*a* of the heat pipe 1*a*, so as to complete the manufacture of the heat pipe 1*a*.

Since the heat pipe 1*a* is a component extended lengthwise, an end closure of the heat pipe 1*a* protruded to the outside is hit very frequently by other objects. If the end closure is hit by external forces, the pipe body 10*a* will be collided and deformed easily, since the heat pipe 1*a* has not gone through any hardening process. The pipe body 10*a*, particularly the end closure of the heat pipe 1*a* made of a softer metal such as copper may be hit and deformed by external forces easily. As the external diameter of the heat pipe 1*a* becomes smaller after the heat pipe 1*a* is tapered, and the plastic deformation of the compressed metal damages the internal structure of the heat pipe 1*a*, the heat pipe 1*a* is no longer as strong as before, and thus the end closure of conventional heat pipes 1*a* may be broken or cracked easily when the heat pipes 1*a* are collided by external forces, and the damaged heat pipes 1*a* cannot be used anymore.

SUMMARY OF THE INVENTION

In view of the foregoing shortcomings of the prior art, the inventor of the present invention based on years of experience in the related industry to conduct experiments and modifications, and finally developed an anti-breaking structure of an end closure of a heat pipe in accordance with the present invention.

Therefore, it is a primary objective of the present invention to provide an anti-breaking structure of an end closure of a heat pipe, and the anti-breaking structure is formed at an end closures of the heat pipe, so that the strength of the original flat compressed pipe wall of the heat pipe can be enhanced for providing good reinforcements to the heat pipe to bear a larger impact or stress and preventing the heat pipe from being deformed, bent, cracked or broken.

Another objective of the present invention is to provide an anti-breaking structure of an end closure of a heat pipe, and the anti-breaking structure is formed at the heat pipe by compressing the pipe wall during the process of sealing the heat pipe, and thus the strength of the end closure of the heat pipe can be enhanced effectively without increasing the manufacturing time and cost.

To achieve the foregoing objective, the present invention provides an anti-breaking structure of an end closure of a heat pipe, and the anti-breaking structure is formed at a tapered end of the heat pipe, and a soldering joint is formed at an upper end of the anti-breaking structure. The anti-breaking structure includes an uneven rib coupled longitudinally between the tapered end and the soldering joint, and two wing portions extended outward from the left and right outer sides of the uneven rib, and one surface of the uneven rib is convex and another back surface of the uneven rib is concave, and both uneven rib and wing portions are formed by compressing the heat pipe to constitute the anti-breaking structure.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

Figure 1:
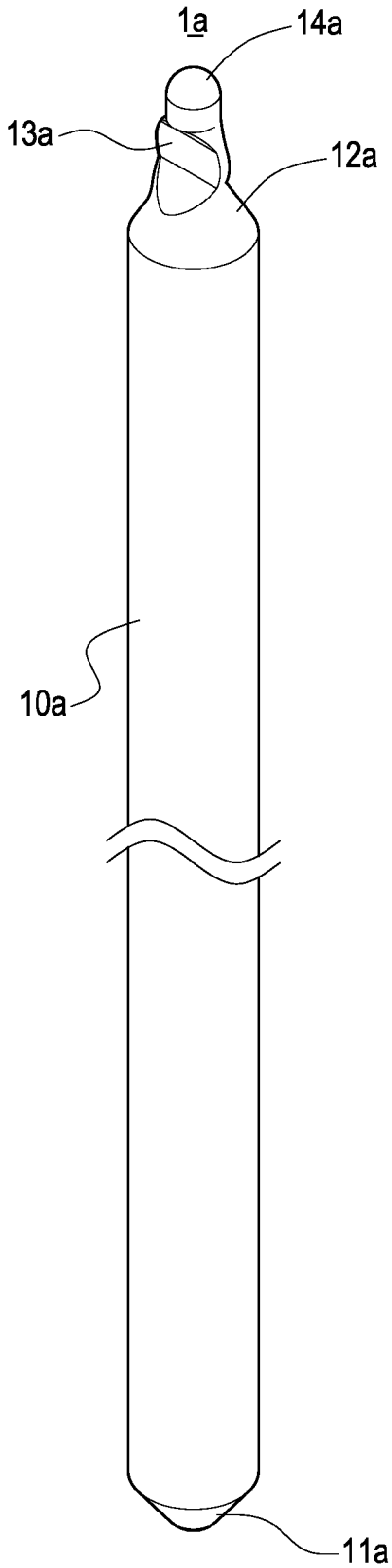
FIG.1 PRIOR ART
FIG. 1 is a perspective view of a conventional heat pipe.
Figure 2:
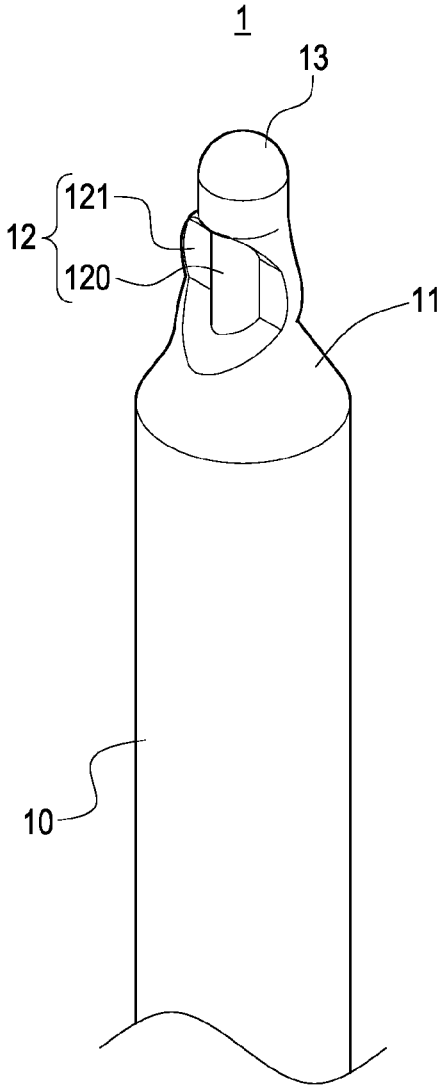
FIG. 2 is a perspective view of a portion of an end closure of a heat pipe of the present invention.
Figure 3:
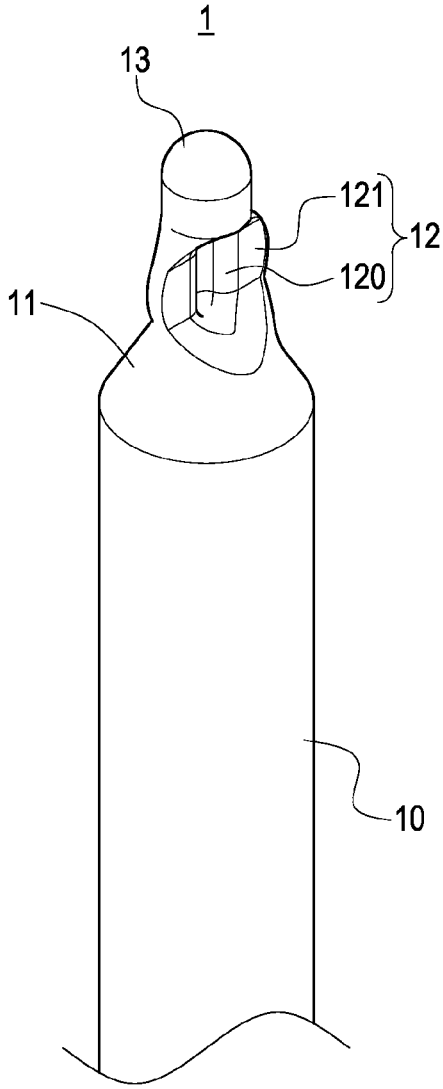
FIG. 3 is a perspective view of a portion of FIG. 2 viewed at another angle.

Referring to FIGS. 2 and 3 for a schematic view of a portion of an end closure of a heat pipe of the present invention and a schematic view of FIG. 2 viewed at another angle respectively, the present invention provides an anti-breaking structure of an end closure of a heat pipe, and an anti-breaking structure 12 is formed at a tapered end 11 of a pipe body 10 of the heat pipe 1 for increasing the strength of the end closure of the heat pipe 1 to prevent the end closure from being broken or cracked accidentally, in addition to sealing the pipe body 10 of the heat pipe 1.

Figure 4:
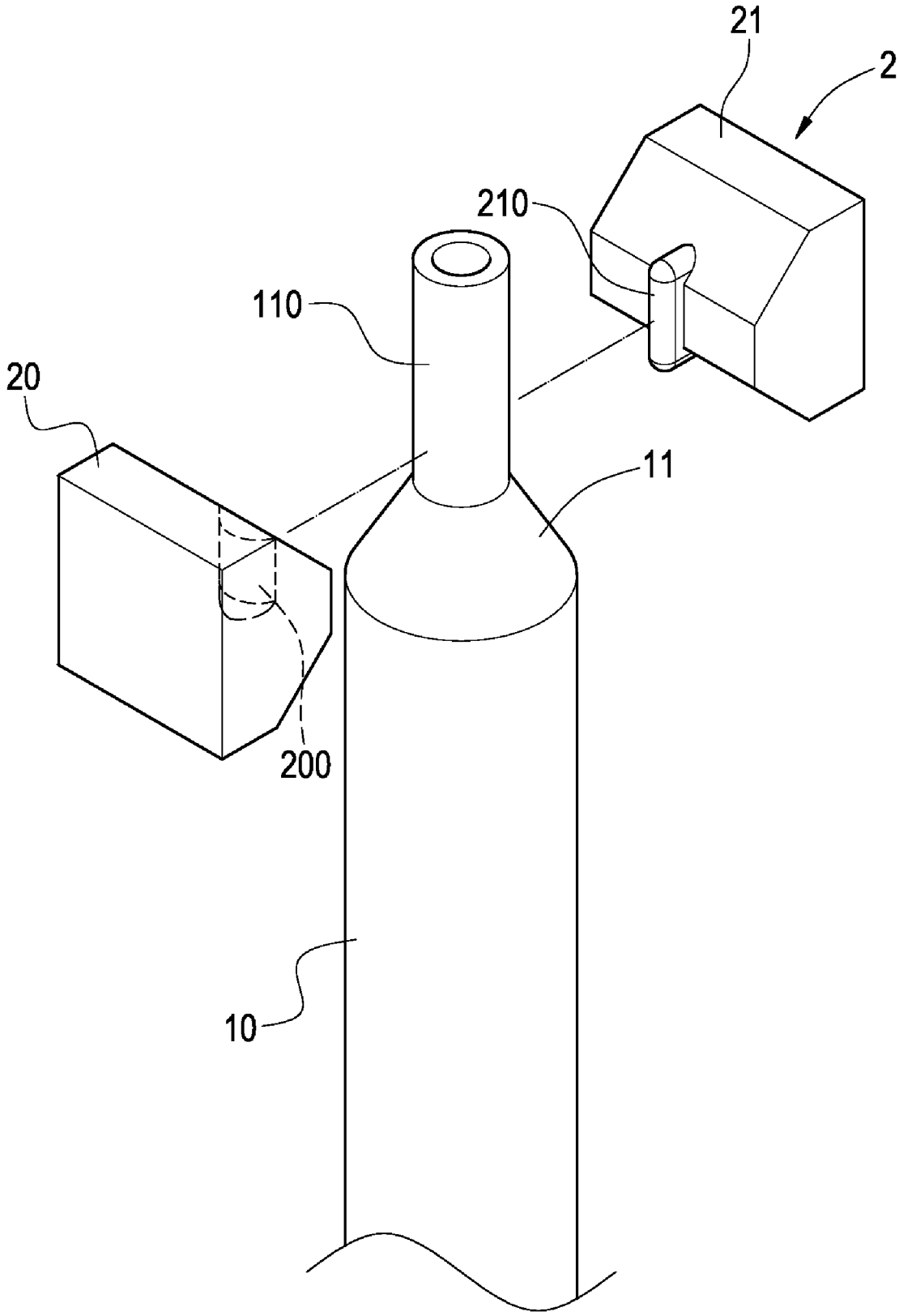
FIG. 4 is a perspective view of moving a closure in accordance with the present invention.
Figure 5:
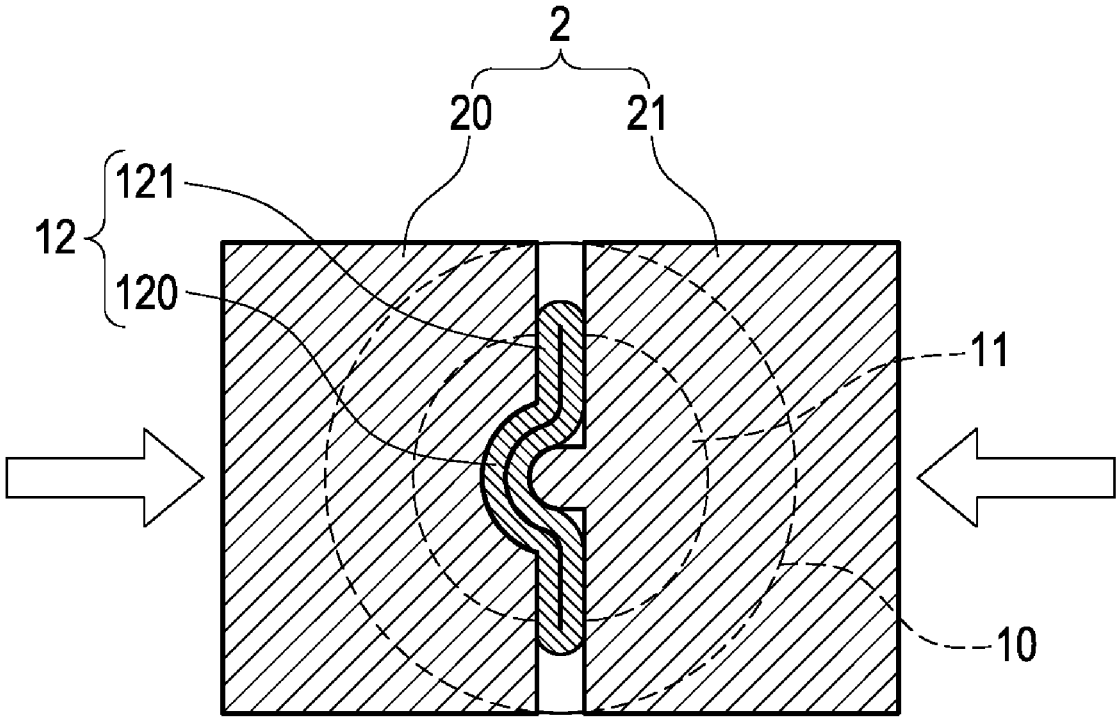
FIG. 5 is a top view of a closure after being moved in accordance with the present invention.

Referring to FIG. 4, a tapered portion 110 with a smaller diameter is formed at a position proximate to the tapered end 11 of the pipe body 10 of the heat pipe 1, when the anti-breaking structure 12 is formed. The tapered portion 110 is formed by a pipe tapering process, wherein the external diameter of the tapered end 11 is smaller than the external diameter of the pipe body 10 of the heat pipe 1, and then a pressing mold 2 is used to compress the tapered portion 110 of the heat pipe 1. The pressing mold 2 includes a first pressing module 20 and a second pressing module 21, and the first and second pressing modules 20, 21 have corresponding concave and convex objects 200, 210 respectively for compressing the tapered portion 110 of the heat pipe 1 laterally inward from two corresponding opposite sides, such that the pipe wall of the tapered portion 110 are compressed into a flat shape, and the internal pipe walls of the tapered portion 110 are joined, so as to form the anti-breaking structure 12 on the tapered portion 110 as shown in FIG. 5.

Figure 6:
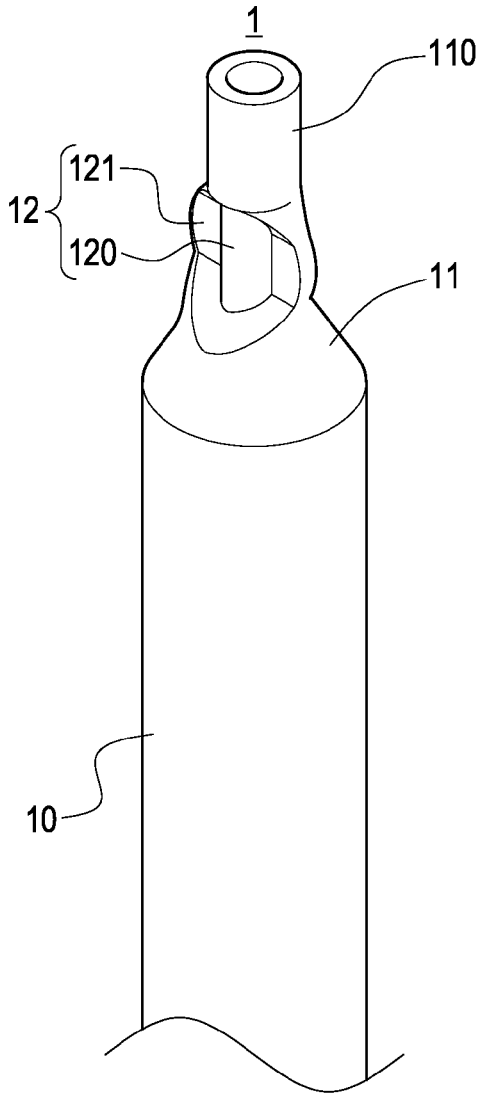
FIG. 6 is a schematic view of a portion of moving a closure in accordance with the present invention.
Figure 7:
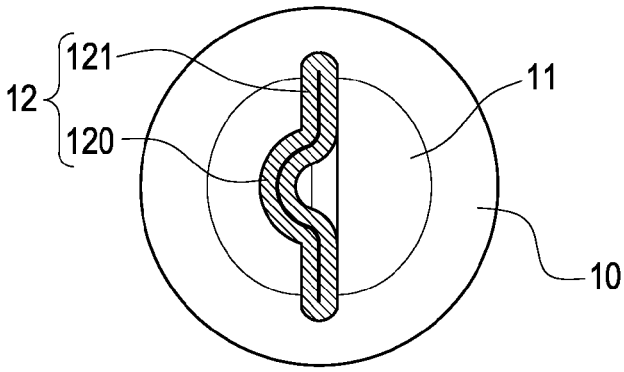
FIG. 7 is a cross-sectional view of an anti-breaking structure of the present invention.

The anti-breaking structure 12 includes an uneven rib 120, and a wing portion 121 extended separately outward from both left and right side of the uneven rib 120, wherein the uneven rib 120 is formed by pressing the concave and convex objects 200, 210 of the first and second pressing modules 20, 21, and the two wing portions 121 are formed by pressing the remaining planes of the first and second pressing modules 20, 21. In FIG. 6, the formed uneven rib 120 and the two wing portions 121 are disposed between the tapered portion 110 and the remaining tapered portion 110, and the uneven rib 120 is extended longitudinally. In FIG. 7, the anti-breaking structure 12 has a substantially "Ω"-shaped cross section, and the remaining tapered portion 110 is soldered to form a soldering joint 13 (as shown in FIGS. 2 and 3), while the heat pipe 1 is sealed and the anti-breaking structure 12 is formed.

With the foregoing structure, the anti-breaking structure for an end closure of a heat pipe can be achieved.

Referring to FIGS. 2 and 3 again, the anti-breaking structure 12 is formed at the end closure of the heat pipe 1, such that the uneven rib 120 of the anti-breaking structure 12 can be extended longitudinally and coupled between the tapered portion 11 and the soldering joint 13, and one surface of the uneven rib 120 is convex and another backside of the uneven rib 120 is concave, and thus the original flat pipe wall are reinforced by the uneven rib 120. If the end closure of the heat pipe 1 is hit by an external force, the end closure of the heat pipe 1 can bear a larger impact or stress and prevent the heat pipe 1 from being deformed, bent, cracked or broken. In the meantime, the anti-breaking structure 12 is formed at the heat pipe 1 during the process of sealing the heat pipe 1, and thus the anti-breaking structure 12 can be formed at the pipe wall (which is the tapered portion 110) by the sealing and compressing processes, so as to effectively enhance the strength of the end closure of the heat pipe 1 without increasing the manufacturing time and cost.

Figure 8:
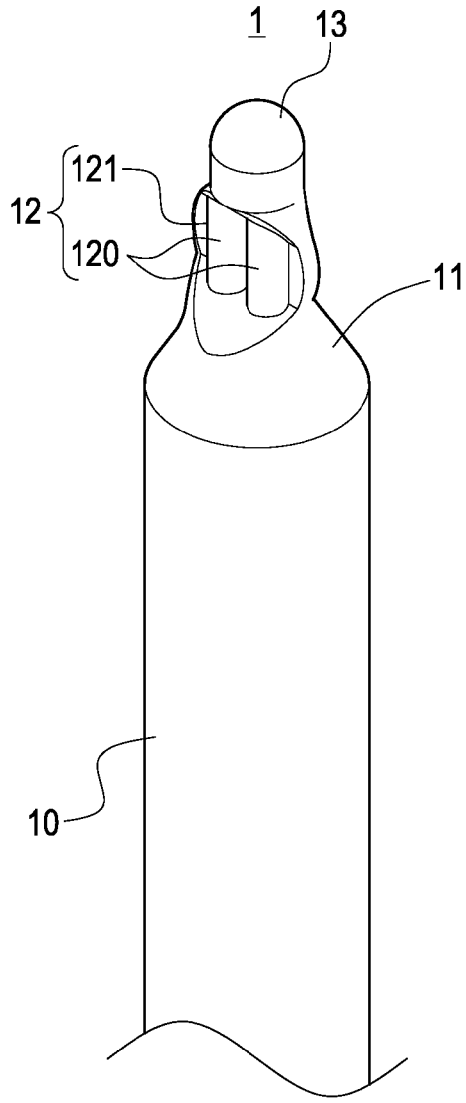
FIG. 8 is a schematic view of a portion of an end closure of a heat pipe in accordance with another preferred embodiment of the present invention.
Figure 9:
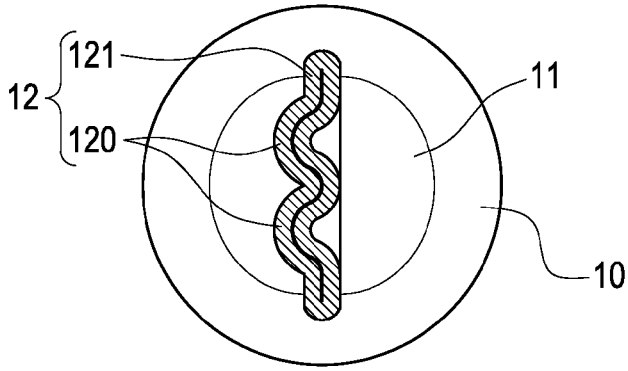
FIG. 9 is a cross-sectional view of a further preferred embodiment of the present invention.

In FIGS. 8 and 9, the quantity of uneven ribs 120 disposed on the anti-breaking structure 12 is increased. In this embodiment, two parallel uneven ribs 120 are formed on the anti-breaking structure 12, and the two wing portions 121 are extended outward from the outer sides of the two uneven ribs 120.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An anti-breaking structure of an end closure of a heat pipe, formed on a tapered end of the heat pipe, and having a soldering joint disposed at an upper end of the anti-breaking structure, and the anti-breaking structure comprising:

an uneven rib, being a rib protruded from a surface and sunken into another backside surface, and coupled longitudinally between the tapered end and the soldering joint, and formed by compressing a pipe wall of the heat pipe; and two wing portions, extended from left and right sides of the uneven rib respectively, and formed by compressing a pipe wall of the heat pipe, and coupled between the tapered end and the soldering joint.

2. The anti-breaking structure of an end closure of a heat pipe of claim 1, wherein the anti-breaking structure has a substantially "Ω"-shaped cross section.

3. An anti-breaking structure of an end closure of a heat pipe, formed on a tapered end of the heat pipe, and having a soldering joint disposed at an upper end of the anti-breaking structure, and the anti-breaking structure comprising:

a plurality of uneven ribs, protruded from a surface and sunken into another backside surface, and arranged in parallel with each other, and coupled longitudinally between the tapered end and the soldering joint, and formed by compressing a pipe wall of the heat pipe; and two wing portions, extended outward from left and right sides of the outer uneven ribs respectively, and formed by compressing a pipe wall of the heat pipe, and coupled between the tapered end and the soldering joint.

* * * * *